US007550691B2

(12) United States Patent
Wristen et al.

(10) Patent No.: US 7,550,691 B2
(45) Date of Patent: Jun. 23, 2009

(54) ADJUSTABLE SWITCHING MECHANISM FOR SERIES COUPLED VACCUM INTERRUPTERS

(75) Inventors: Cecil C. Wristen, Hudson, OH (US); James G. Meadows, Garrettsville, OH (US); Michael G. Walaszewski, Parma Hts., OH (US); William D. Mozina, Parma Hts., OH (US)

(73) Assignee: Vacuum Electric Switch Co., Akron, OH (US)

( * ) Notice: Subject to any disclaimer, the term of this patent is extended or adjusted under 35 U.S.C. 154(b) by 14 days.

(21) Appl. No.: 11/904,564

(22) Filed: Sep. 27, 2007

(65) Prior Publication Data

US 2009/0084762 A1 Apr. 2, 2009

(51) Int. Cl.
*H01H 9/40* (2006.01)
*H01H 33/14* (2006.01)

(52) U.S. Cl. ..... 218/2; 218/4; 218/5; 218/7

(58) Field of Classification Search ..... 218/2–7
See application file for complete search history.

(56) References Cited

U.S. PATENT DOCUMENTS 3,159,731 A * 12/1964 Luehring ..... 218/4

OTHER PUBLICATIONS

*Joslyn VBM Fault Interrupter* Joslyn Hi-Voltage Corporation; D.B. 750-502 Revised Apr. 1992.

* cited by examiner

*Primary Examiner*—Ramon M Barrera
(74) *Attorney, Agent, or Firm*—Renner Kenner Greive Bobak Taylor & Weber

(57) ABSTRACT

An adjustable switching mechanism for adjusting the tolerance of electrical contacts of series coupled vacuum interrupters includes a primary drawbar coupled to a secondary drawbar via a pair of coupling pull rods. The primary and secondary drawbars are adjustably attached to the coupling pull rods by a plurality of adjustable compression assemblies. The primary drawbar also includes an attachment bore having threads of one dimension to threadably receive a double-threaded part therethrough. The double-threaded part also includes an internal bore having threads of another dimension in which to receive a coupling screw. As such, the tolerance between the electrical contacts of the vacuum interrupters may be changed through adjustment of the compression assemblies and the rotation of the double-threaded part.

13 Claims, 5 Drawing Sheets

ADJUSTABLE SWITCHING MECHANISM FOR SERIES COUPLED VACCUM INTERRUPTERS

TECHNICAL FIELD

The present invention relates generally to vacuum interrupters. Particularly, the present invention relates to a switching mechanism used to actuate at least two series coupled vacuum interrupters. Specifically, the present invention relates to an adjustable switching mechanism that allows the user to precisely adjust the point at which the contacts of at least two series coupled vacuum interrupters open and close, so that the switching operation of each vacuum interrupter is synchronized with the other.

BACKGROUND ART

Vacuum interrupters are used to control the application of large amounts of electrical power to an electrical load. However, in circumstances where the voltage requirements of the load exceed the voltage rating of an individual vacuum interrupter, multiple interrupters are electrically coupled in series to form a vacuum interrupter assembly. By placing the vacuum interrupters in series, the effective voltage rating of the entire vacuum interrupter assembly is increased. To enable series operation of the vacuum interrupters, a mechanical switching mechanism is used to actuate the movable contacts of each vacuum interrupter in a synchronous or otherwise simultaneous manner. As such, when the switching mechanism is actuated it results in either the simultaneous opening or simultaneous closing of the electrical contacts of the vacuum interrupters, so as to effectuate the simultaneous switching on and off of electrical current flowing therethrough.

The simultaneous opening and closing of the contacts of series coupled vacuum interrupters is critical in order to ensure that the voltage applied is evenly distributed across each individual vacuum interrupter. If the contacts of one vacuum interrupter open before the contacts of the other, the entire terminal-to-terminal voltage is applied to only a single interrupter. As a result, the voltage rating of the vacuum interrupter whose contacts are open would be exceeded, and the vacuum interrupter would not be able to stop the current flowing through the vacuum interrupter with the open contacts. Furthermore, the sustained electrical current through the single vacuum interrupter with the open contacts would eventually result in the destruction of the vacuum interrupter altogether.

To ensure that the switching mechanism provides simultaneous switching of the contacts of each of the series coupled interrupters, most mechanical switching mechanisms employ some type of adjustment mechanism. The adjustment mechanism is configured to enable one to adjust the point at which the contacts of each series coupled interrupters opens and closes relative to each other. For example, a prior art adjustable switching mechanism, generally designated by the numeral 10, as shown in FIG. 1, is used to mechanically actuate a pair of series coupled vacuum interrupters 20 and 22 that are maintained within the housings provided by respective vacuum interrupter modules 24 and 26, which together comprise a vacuum interrupter module assembly 28. However, before setting forth the structural aspects of the adjustable switching mechanism 10, a brief description of the structural and functional interrelation of the components maintained by the interrupter modules 24 and 26 will be provided.

The series coupled vacuum interrupters 20 and 22, maintained within respective interrupter modules 24,26, include movable contacts 32A-B and respective fixed contacts 34A-B. Specifically, the fixed contact 34A of the vacuum interrupter 20 is connected to a conductive input terminal pad 40, which is configured to be coupled to any suitable power supply or electrical circuit in which electrical switching is desired. The vacuum interrupter module 24 also includes a conductive flexible shunt 50 that is used to couple the movable contact 32A to a conductive intermediate plate 60. Also coupled to the conductive intermediate plate 60 is the fixed contact 34B of the interrupter module 26. Whereas, the movable contact 32B of the interrupter module 26 is coupled by a flexible shunt 70 to a conductive output terminal pad 80, which is configured to be coupled to any suitable power supply or electrical circuit in which electrical switching is desired.

As such, when the contacts 32A-B and 34A-B are closed as shown, electrical current flows into the input terminal pad 40, through the closed contacts 34A and 32A and then through the flexible shunt 50 of the interrupter module 24. After moving through the flexible shunt 50, the electrical current passes through the conductive intermediate plate 60 before flowing through the closed contacts 34B and 32B of the module 26. After passing through the contacts 34B and 32B, the electrical current flows through the flexible shunt 70 where it exits the interrupter module 26 via the outlet terminal pad 80.

In order to simultaneously actuate the movable contacts 32A and 32B of respective vacuum interrupters 20 and 22, the adjustable switching mechanism 10 is utilized. The adjustable switching mechanism 10 provides a primary drawbar 90, which is contained within the vacuum interrupter module 26, that is coupled to a secondary drawbar 92, which is contained within the vacuum interrupter module 24, via a pair of spaced, parallely oriented, slidably movable, coupling pull rods 94A and 94B. The pull rods 94 are provided with a relatively smooth outer surface. As can be seen, the pull rods are slidably received in both vacuum interrupter modules 24 and 26, and as such, slidably pass through the adjacent ends of the modules 24 and 26 and the intermediate plate 60. Furthermore, the primary drawbar 90 is attached to the movable contact 32B of vacuum interrupter 22, while the secondary drawbar 92 is coupled to the movable contact 32A of vacuum interrupter 20. In addition, the primary drawbar 90 is coupled to a primary pull rod 100 that is actuated by a suitable electromechanical switchgear (not shown) that imparts an actuation force to the adjustable switching mechanism 10, so as to simultaneously open and close the contacts 32A-B, 34A-B. Thus, when the primary pull rod 100 is moved in the direction A, the primary drawbar 90 moves the movable contact 32B away from the fixed contact 34B. And simultaneously with the movement of the primary drawbar 90 in the direction A, the pull rods 94A and 94B move the secondary drawbar 92 in the direction A, also resulting in the movable contact 32A being moved away from fixed contact 34A. As such, electrical current flowing through the vacuum interrupters 20 and 22 is stopped. Alternatively, when the primary drawbar 90 is moved in the direction B, the movable contacts 32A-B of the vacuum interrupters 20,22 are urged toward respective fixed contacts 34A-B to enable electrical current to flow through the interrupters 20 and 22.

However, because of the variation in the relative tolerances of the positioning of the contacts 32A-B and 34A-B with respect to one another, as well as the difference in the dimensions of the coupling pull rods 94A-B and drawbars 90 and 92, the contacts 32,34 of the vacuum interrupters 20 and 22 may not open and close simultaneously. As such, the adjustable switching mechanism 10 provides a pair of pull rod adjustment assemblies 110A and 110B that are respectively associated with each coupling pull rod 94A and 94B. The pull rod adjustment assemblies 110A and 110B are maintained by the primary drawbar 90, and allow the distance between the primary and secondary drawbars 90,92 to be adjusted so that the point at which the contacts 32A-B and 34A-B of the vacuum interrupters 20 and 22 open and close can be altered so that the contacts 32,34 of the vacuum interrupters 20,22 open and close simultaneously.

Because the adjustment assemblies 110A and 110B are structurally equivalent, only the discussion of the adjustment assembly 110A will be presented, as shown in FIG. 2. The primary drawbar 90 provides a pair of horizontally oriented and spaced arms 140A and 140B which form a cavity 160 therebetween. Each of the arms 140A,140B has a corresponding vertically-oriented and axially-aligned bore 130A and 130B. It will further be appreciated that each bore 130A, 1 30B provides a gripping serration 120A, 120B that is engageable with the relatively smooth outer surface of the pull rod received in the bore. Also disposed through the arm 140A is a threaded bore 150 that is dimensioned to receive and mesh with a locking screw 152 which includes a tapered end 154. A locking wedge 162 is disposed and received within the cavity 160. The locking wedge 162 includes a beveled bore 164 that is substantially axially aligned with the threaded bore 150. The beveled bore 164 also includes a concave serrated retaining surface 166. In other words, the serrated retaining surface 166 is shaped so as to be aligned with the bores 130A and 130B, and engageable with the outer surface of the respective rod 94A received therein.

Thus, to maintain the positioning of the primary drawbar 90 relative to the secondary drawbar 92, the locking screw 152 is threaded into the corresponding threaded bore 150 of the primary drawbar 90. As the tapered end 154 of the locking screw 152 is received within the beveled bore 164 of the locking wedge 162, the serrated concave surface 166 is urged against the coupling pull rod 94A. Furthermore, because the coupling pull rod 94A is typically formed from a relatively soft material, such as fiberglass or plastic for example, the gripping serrations 120A and 120B tend to grab or otherwise bite into the pull rod 94A to hold it in place.

Therefore, as adjustment of the coupling pull rods 94 A-B are needed to maintain the necessary tolerance between the primary and the secondary drawbars 90,92 the locking screw 152 of each adjustment assembly 110A,110B is initially loosened. The loosening of the locking screw 152 results in the loosening of the locking wedge 162. Once in this state, the coupling pull rods 94A-B can be freely moved through the bores 130A-B of the primary drawbar 90. As such, the distance between the primary and secondary drawbars 90,92 can be modified so that the relative positioning of the contacts 32A-B and 34A-B can be modified so that they open and close synchronously with each other.

However, because of the relatively tight fit between the pull rods 94A-B and the bores 130A-B, a substantial amount of force is required to be applied by the user to move the coupling pull rods 94A-B therethrough, making precise adjustments difficult. Moreover, because each coupling pull rod 94A-B must be individually adjusted, a user must expend significant time and care in ensuring that when an adjustment is made that the primary and secondary drawbars 90,92 remain parallel with each other to ensure that the contacts 32A-B and 34A-B are actuated simultaneously. In addition, due to the nature of the serrated locking wedge 162 it is prone to allow the coupling pull rods 94A-B to slip over time, resulting in the gradual misalignment of the primary and secondary drawbars 90,92. Furthermore, the adjustment of the drawbars 90,92, as discussed, requires that the vacuum interrupter module assembly 28 be physically removed, or otherwise detached from the electromechanical switchgear or switching mechanism (not shown), while the associated modules 24,26 are required to be at least partially disassembled. Such an endeavor, however makes the adjustment of the switching mechanism 10 in the field tedious and time consuming, which is unwanted.

Therefore, there is a need for an adjustable switching mechanism that allows the contacts of a pair of series coupled vacuum interrupter modules to be precisely adjusted so that the contacts maintained thereby simultaneously open and close. Additionally, there is a need for an adjustable switching mechanism that provides an adjustable double-threaded part and adjustable coupling screw that allow the contacts of a pair of series coupled vacuum interrupters to be precisely adjusted without physically removing the vacuum interrupter module assembly 28 from the electromechanical switch gear or switching mechanism. Furthermore, there is a need for an adjustable switching mechanism that utilizes compression assemblies to allow the positioning between the primary and the secondary drawbars to be adjusted so that the contacts simultaneously open and close. In addition, there is a need for an adjustable switching mechanism that allows the contacts of a pair of series coupled vacuum interrupter modules to be precisely adjusted without physically removing the switching mechanism from the interrupter modules.

DISCLOSURE OF THE INVENTION

Therefore, one aspect of the present invention is to provide an adjustable switching mechanism for series coupled vacuum interrupters.

Another aspect of the present invention is to provide a switching mechanism for actuating vacuum interrupters comprising a primary drawbar, a secondary drawbar, at least one secondary pull rod that joins the primary and secondary drawbars, a double-threaded part threadably coupled to the primary drawbar, the double-threaded part having a threaded internal bore, a coupling screw having one end received within the threaded internal bore, and a first and a second vacuum interrupter coupled in series, each interrupter having a movable contact and a fixed contact, wherein the movable contact of the first vacuum interrupter module is coupled to another end of the coupling screw, and the movable contact of the second vacuum interrupter module is coupled to the secondary drawbar, such that the rotation of the double threaded part moves the movable contacts relative to each other.

Yet another aspect of the present invention is to provide an adjustable switching mechanism for actuating the movable contacts of a plurality of series coupled vacuum interrupters comprising a primary drawbar having an attachment bore and a pair of adjustable compression assemblies, a secondary drawbar adapted to be coupled to one of the movable contacts, a pair of coupling pull rods attached at one end to the secondary drawbar, and attached at another end to the primary drawbar via the adjustable compression assemblies, and a double-threaded part having threads of one pitch dimension, the double-threaded part threadably received within the attachment bore, the double-threaded part having an internal bore having threads of another pitch dimension to threadably receive a coupling screw that is adapted to be coupled to another of the movable contacts, wherein the rotation of the double-threaded part changes the position of the primary drawbar relative to the double-threaded part by the difference between the pitches.

Still another aspect of the present invention is to provide an adjustable switching mechanism for series coupled vacuum interrupters, each vacuum interrupter having a movable contact that mates with a fixed contact, the switching mechanism comprising a primary pull rod, a primary draw bar coupled to the primary pull rod, the primary draw bar moving a first movable contact with respect to a first fixed contact, at least one secondary pull rod having a first end and a second end, a secondary draw bar moving a second movable contact with respect to a second fixed contact, a first compression assembly adjustably positioning and connecting the primary draw bar to the first end of the at least one secondary pull rod, a second compression assembly adjustably positioning and connecting the secondary draw bar to the second end of the at least one secondary pull rod, and a double-threaded part carried by the primary pull rod and the primary draw bar, wherein positioning of the compression assemblies coarsely adjusts the movable contacts with respect to the fixed contacts, and wherein positioning of the double-threaded part finely adjusts the movable contacts with respect to the fixed contacts.

Yet another aspect of the present invention is to provide an adjustable switching mechanism for series coupled vacuum interrupter modules, each interrupter module having a movable contact that mates with a fixed contact, the switching mechanism comprising a primary pull rod, a primary draw bar coupled to the primary pull rod, the primary draw bar moving a first movable contact with respect to a first fixed contact, at least one secondary pull rod having a first end and a second end, a secondary draw bar moving a second movable contact with respect to a second fixed contact, the secondary draw bar connected to the second end of the secondary pull rod, and a first compression assembly adjustably positioning and connecting the primary draw bar to the first end of the at least one secondary pull rod, wherein positioning of the first compression assembly coarsely adjusts the movable contacts with respect to the fixed contacts.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
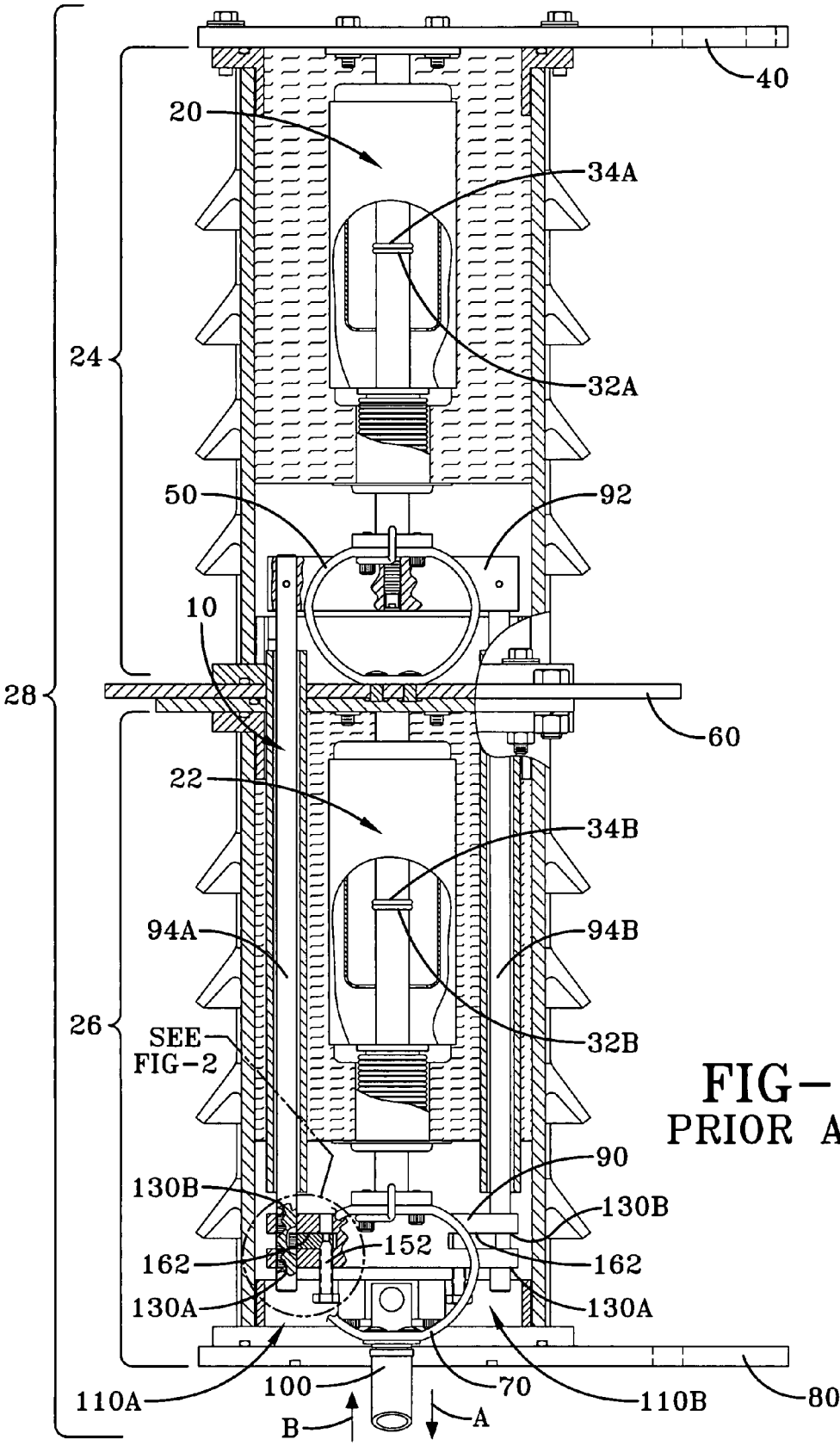
FIG-1 PRIOR ART
FIG. 1 is a cross-sectional view of a pair of series coupled interrupter modules utilizing a prior art adjustable switching mechanism.
Figure 2:
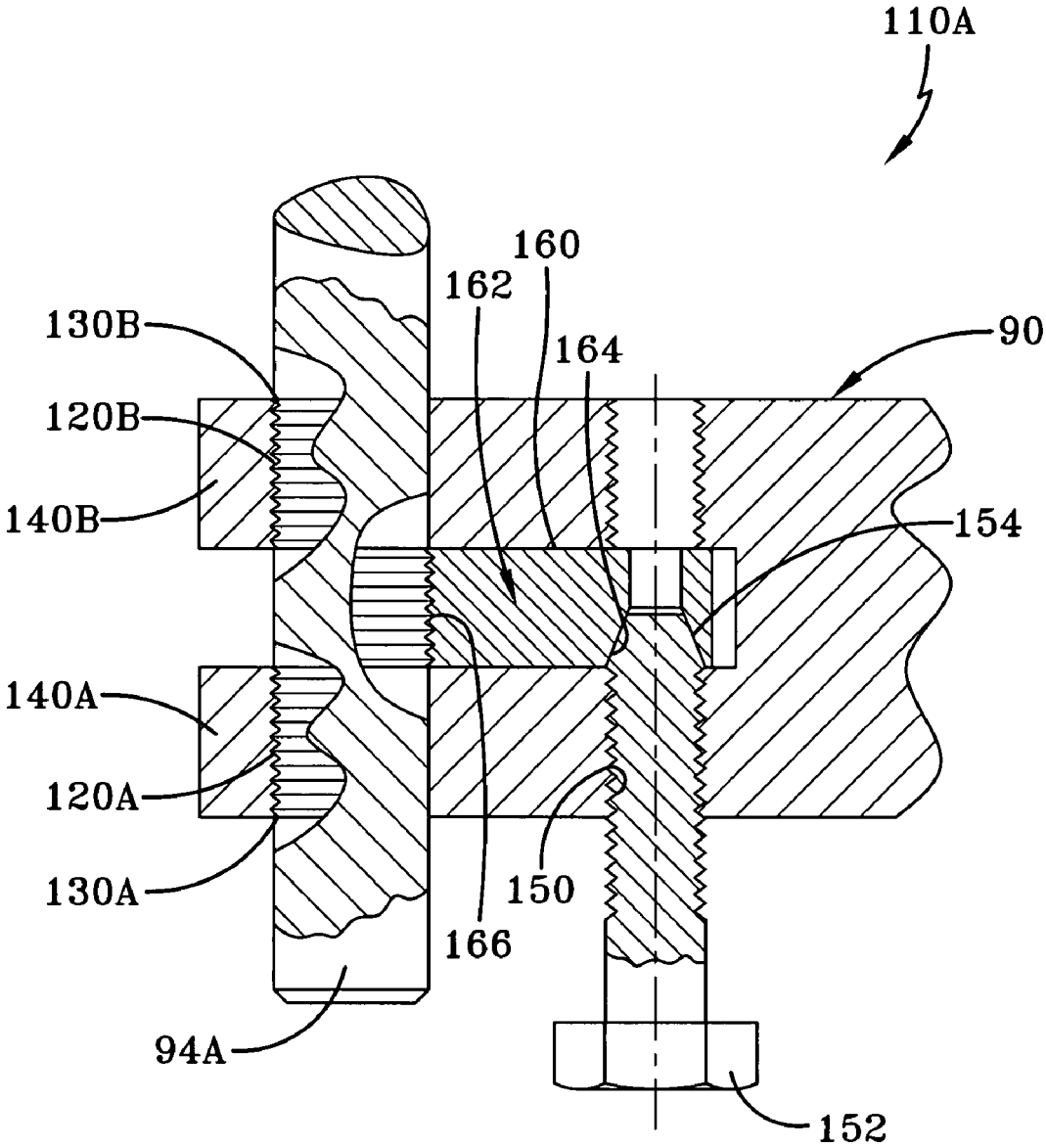
FIG-2 PRIOR ART
FIG. 2 is a cross-sectional view of a prior art adjustment assembly maintained by the adjustable switching mechanism.
Figure 3:
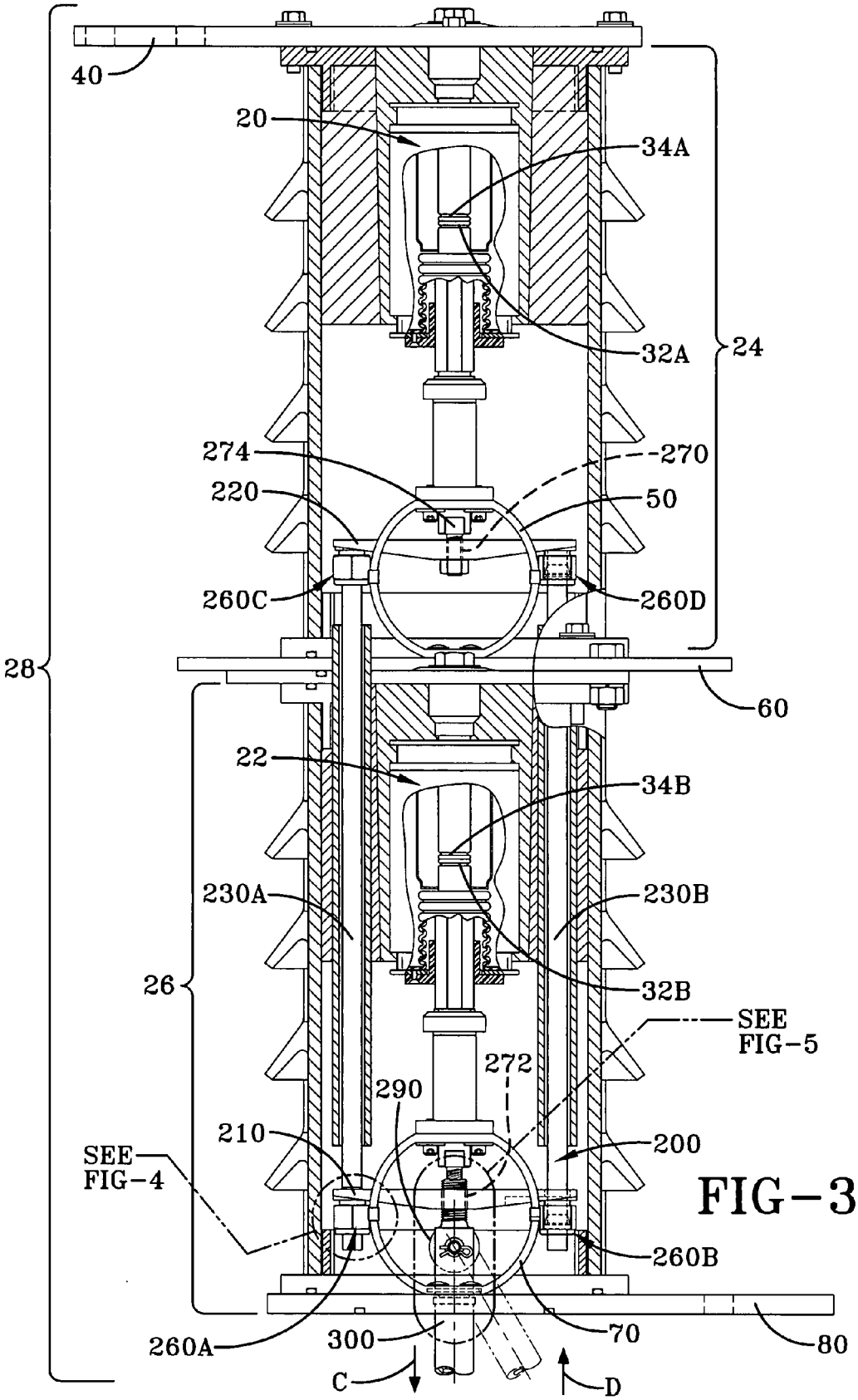
FIG. 3 is a cross-sectional view of a pair of series coupled interrupter modules utilizing an adjustable switching mechanism in accordance with the concepts of the present invention.

An adjustable switching mechanism for controlling multiple series coupled vacuum interrupters is generally referred to by the numeral 200 as shown in FIG. 3 of the drawings. The switching mechanism 200 discussed below is configured for use with the two series coupled vacuum interrupters 20 and 22 maintained by the interrupter module assembly 28 as previously discussed. Any structural features associated with the interrupter module assembly 28 described in the background but not specifically discussed in this section are hereby incorporated. In any event, it should be appreciated that the adjustable switching mechanism 200 can be easily modified and adapted for use with more than two vacuum interrupters.

The switching mechanism 200 comprises a primary drawbar 210 that is coupled to a secondary drawbar 220 via a pair of spaced, substantially parallel coupling pull rods 230A and 230B. The coupling pull rods 230A and 230B are coupled to the primary and secondary drawbars 210,220 by adjustable compression assemblies 260A-D. In addition, the secondary drawbar 220 includes a threaded attachment bore 270, while the primary drawbar 210 includes a threaded attachment bore 272. The threaded attachment bore 270 allows the secondary drawbar 220 to be coupled by a suitable fastener 274, such as a threaded screw, to the movable contact 32A of the vacuum interrupter 20. The primary drawbar 210 is coupled to the movable contact 32B of the vacuum interrupter 22 via an adjustable double-threaded part 290 that is threadably received within the threaded attachment bore 272 in a manner that will be described in more detail. A primary pull rod 300 is pivotally attached at one end to the double-threaded part 290, while another end of the pull rod 300 is attached to an electromechanical switchgear (not shown) that actuates the drawbars 210,220 in the direction C and D, as shown in FIG. 3, to simultaneously actuate the series coupled vacuum interrupters 20 and 22 off and on. When secured, the attachment of the pull rod 300 to the electromechanical switchgear prevents the pull rod 300 from rotating in either direction. Of course, other fixtures could be used to prevent rotation of the pull rod 300.

Figure 4:
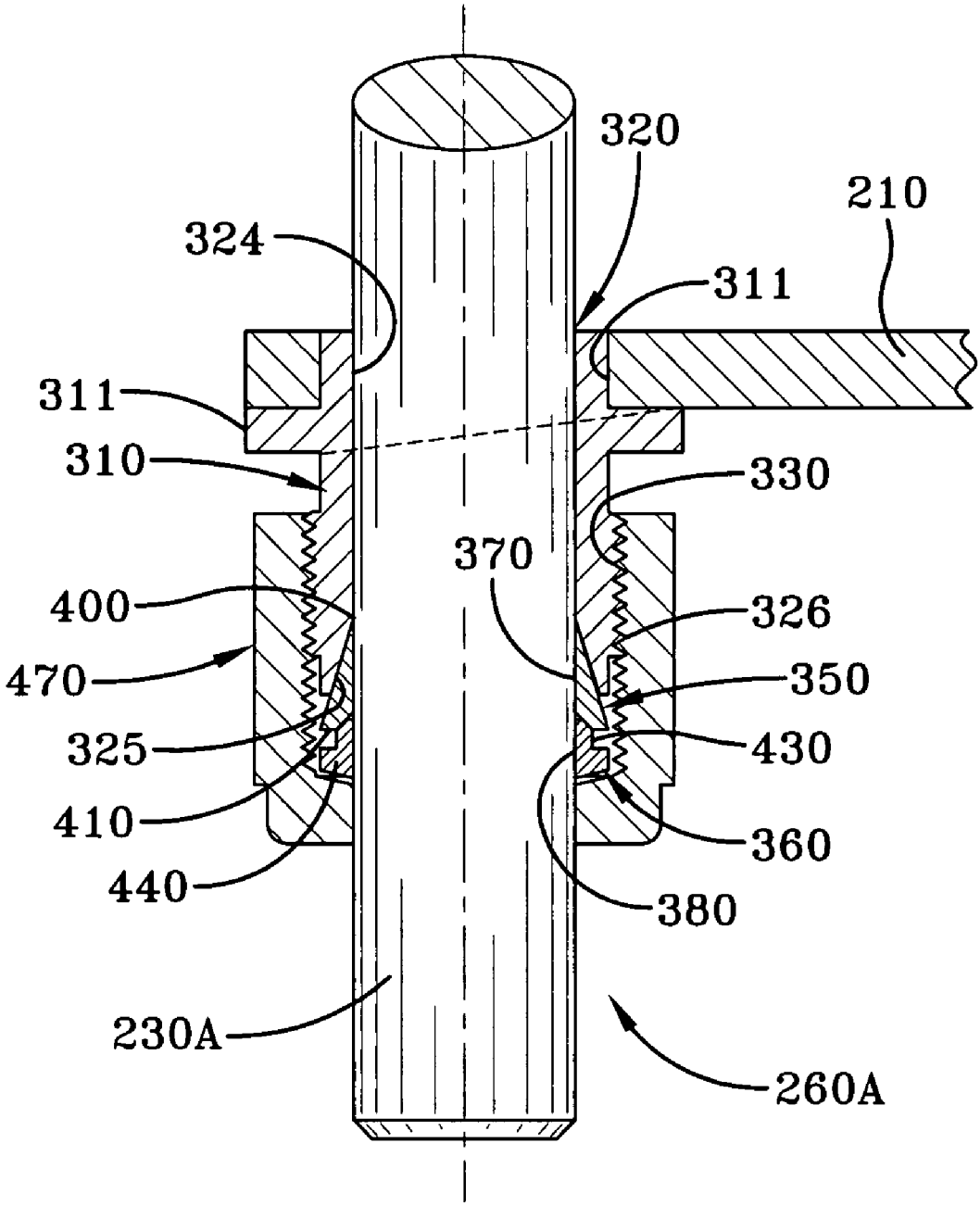
FIG. 4 is a detailed cross-sectional view of a compression assembly provided by the adjustable switching mechanism in accordance with the concepts of the present invention.

The compression assemblies 260A-D are used to coarsely adjust the distance that the drawbars 210 and 220 are spaced from each other, so as to adjust the point at which the vacuum interrupters 20 and 22 turn on and off. In particular, the compression assemblies 260A-D are configured so that assemblies 260A and 260B are maintained by the primary drawbar 210 and assemblies 260C and 260D are maintained by the secondary drawbar 220. However, it should be appreciated that the compression assemblies 260C and 260D are not required to be used, such that the coupling pull rods 230A and 230B are directly fastened to the secondary drawbar 220. Because each of the compression assemblies 260A-D are structurally equivalent, only the compression assembly 260A will be discussed, as shown in FIG. 4. Specifically, the compression assembly 260A includes a fitting body 310 having a base 311. The primary drawbar 210 has an opening 311 that receives the base 311 and is retained therein by any suitable means, such as compression fit or brazing for example. In other words, the fitting body 310 is fixed to the drawbar. The fitting body 310 provides a bore 320 having an inner surface 324 which extends to an outward bevel surface 325, and the body 310 provides an outer surface 326 upon which threads 330 are disposed. The bore 320 is dimensioned so that the pull rod 230A may be readily received therethrough. The compression assembly 260A also includes a tapered ferrule 350 and an annular ferrule 360 each of which includes respective bores 370 and 380 that are each dimensioned to receive the coupling pull rod 230A. The tapered ferrule 350 also includes a tapered end 400 opposite a seat end 410, while the annular ferrule 360 includes inner and outer stepped ends 430 and 440. The tapered ferrule 350 and the annular ferrule 360 are oriented with respect to one another such that, the tapered end 400 of the tapered ferrule 350 is received within the cylindrical bore 320 of the fitting body 310 and is engageable with the bevel surface 325, while the inner step end 430 of the annular ferrule 360 is disposed upon the seat end 410 of the tapered ferrule 350.

To impart a sufficient amount of compression to the ferrules 350 and 360 to prevent the coupling pull rod 230A from sliding through the fitting body 310, a compression fastener 470, which is provided with internal threads, is threaded onto the threads 330 of the fitting body 310. The compression fastener 470 compresses the annular ferrule 360 against the tapered ferrule 350 causing the tapered end 400 to wedge between the coupling pull rod 230A and the inner surface 324 of the fitting body 310 to thereby hold the pull rod 230A in place. While the coupling pull rods 230A-B and bore 320 are shown as being substantially cylindrical, it should be appreciated that the pull rods 230A-B and bore 320 may comprise any suitable cross-sectional shape. It is also contemplated that the pull rods 230A-B may be formed from any suitable material, including plastic or fiberglass for example.

As such, by loosening the compression fastener 470, the user can reposition the drawbars 210,220 relative to one another so as to adjust the spacing that exists therebetween. As such, the compression assemblies 260A-D provides a coarse level of adjustment for positioning each of the contacts 32A-B,34A-B of each of the vacuum interrupters 20,22.

Figure 6:
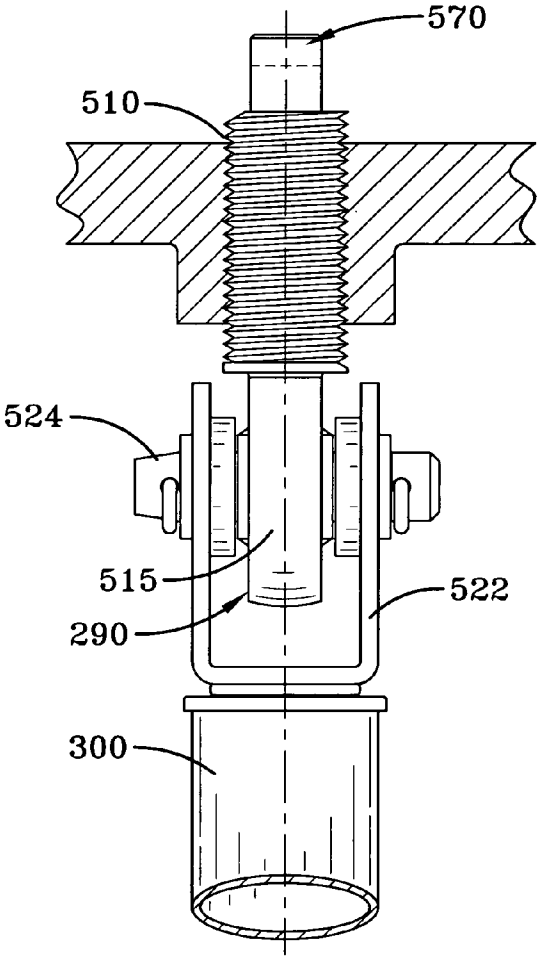
FIG. 6 is an elevational view of the adjustable double-threaded part provided by the adjustable switching mechanism in accordance with the concepts of the present invention.
Figure 5:
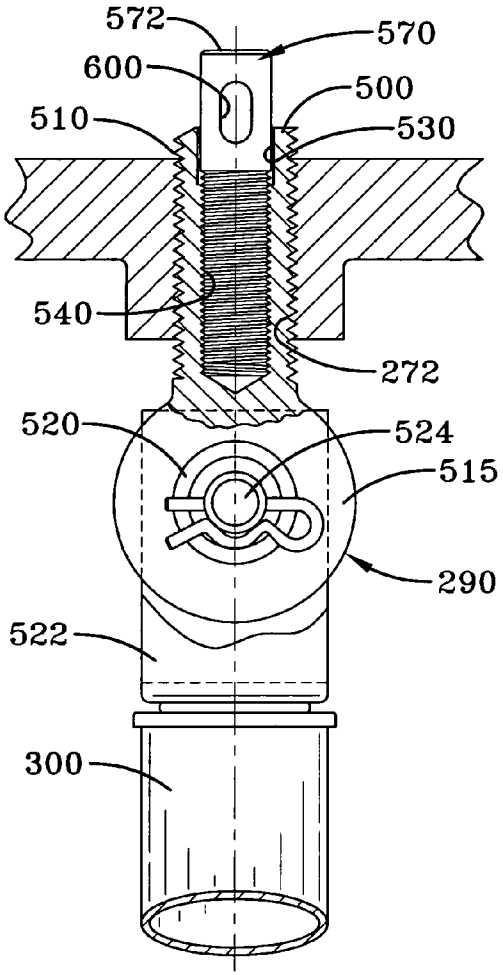
FIG. 5 is a detailed partial cut-away view of an adjustable double-threaded part provided by the adjustable switching mechanism in accordance with the concepts of the present invention.

To more precisely adjust the point at which the contacts 32A-B and 34A-B of the interrupters 20 and 22 open and close, the adjustable switching mechanism 200 utilizes the double-threaded part 290 as shown in FIGS. 5 and 6. One end of the double-threaded part 290 provides a shaft 500 having outer threads 510. The other end of the double-threaded part 290 includes a ring 515 extending from the shaft 500 and wherein the ring 515 has an aperture 520 therethrough. Coupled to the aperture 520 via a yoke 522 and suitable retaining pin 524 is the primary pull rod 300. The primary pull rod 300 may then be coupled at its other end to the electromechanical switchgear (not shown) that moves the adjustable switching mechanism 200 in directions C and D as shown in FIG. 3. In particular, the outer threads 510 of the double-threaded part 290 comprise ½"-20 threads (½ inch diameter, 20 threads per inch) that allow the double-threaded part 290 to be threadably received within the attachment bore 272 of the primary drawbar 210. Disposed within the shaft 500 of the double-threaded part 290 is an internal bore 530 maintaining bore threads 540. The bore threads 540 comprise 5/16"-18 (5/16 inch diameter, 18 threads per inch) threads that allow the internal bore 530 to receive a threaded coupling screw 570. However, it should be appreciated that the outer threads 510 and bore threads 540 may comprise any suitable thread dimension or pitch. The coupling screw 570 includes an end 572, with an aperture 600 therethrough that is configured to be coupled to the movable contact 32B of the vacuum interrupter module 22 via a suitable fastener (not shown). The coupling screw 570 is attached to the moveable contact 32B it is prevented from rotating when the double-threaded part 290 is rotated.

Thus, in addition to the coarse adjustment provided by the compression assemblies 260A-D, the user can precisely adjust the position of the movable contacts 32A-B relative to the fixed contacts 34A-B of the vacuum interrupters 20 and 22 by rotating the double-threaded part 290 by turning the primary pull rod 300. As such, the interrupter module assembly 28, in which the switching mechanism 200 is utilized, does not need to be removed from the electromechanical switchgear or other switching mechanism (not shown) to perform an adjustment of the contacts 32,34 of the vacuum interrupters 20,22. As a result, a technician is able to quickly adjust the switching mechanism 200 by detaching one end of the primary pull rod 300 from the switchgear (not shown) and rotating it to thereby cause the double-threaded part 290 to rotate, thus saving time and resources. As previously discussed, the dimension of the bore threads 540 are 5/16"-18, which correspond to a pitch of 0.0555" per revolution. While the dimension of the outer threads 510 of the double-threaded part 290 are ½"-20, which correspond to a pitch of 0.050" per revolution. As such, when the double-threaded part 290 is rotated a full revolution in either direction, the difference in the dimension of the pitches between the outer threads 510 (0.050") and the bore threads 540 (0.0555") causes the physical dimension between the primary drawbar 210 and the end 572 of the coupling screw 570 to change by the difference (0.005") between the pitches. In other words, when the double-threaded part 290 is rotated a complete revolution in either direction, the distance between the primary drawbar 210 and the end 572 of the coupling screw 570 increases or decreases by the rate of 0.005" per revolution, or by 0.0025" per half revolution. Such a level of adjustment precision is desirable as the tolerance between the movable contacts 32A-B and the fixed contacts 34A-B is approximately 0.006". This change in the distance between the primary drawbar 210 and the end 527 of the coupling screw 570 causes the movable contacts 32A and 32B to move closer to or further away from each other by the adjustment rate of 0.005" per revolution (0.0025" per half revolution). In other words, a full rotation of the primary pull rod 300 moves the double-threaded part 290 a predetermined increment and results in rotation of the coupling screw 570 which moves the coupling screw 570 and the first movable contact 32B a distance somewhat less than the predetermined amount. Once the desired position is obtained, the primary pull rod 300 is re-attached to the switchgear or other fixture (not shown) so as to prevent rotation thereof.

As such, the present invention allows the user to coarsely adjust the position of the movable contacts 32A and 32B relative to the fixed contacts 34A and 34B via the adjustable compression assemblies 260A-D. Once a desired coarse level of adjustment has been achieved through the compression assemblies 260A-D, the relative positions of the movable contact 32B and 34B can be finely or more precisely adjusted by rotating the double-threaded part 290. Once the adjustments have been made as needed to ensure that the movable contacts 32A-B and fixed contacts 34A-B of each interrupter module 20 and 22 open and close simultaneously, or nearly simultaneously with each other, the interrupter modules 24 and 26 may be placed back into operation. Skilled artisans will appreciate that the above-described switching mechanism is advantageous in that it allows coarse and fine adjustment to ensure substantially simultaneous opening and closing of switching contacts. Another advantage is that only minimal dis-assembly is required to make the desired adjustments. And the adjustments can be easily implemented with minimal training of the technician.

Although the present invention has been described in considerable detail with reference to certain embodiments, other embodiments are possible. Therefore, the spirit and scope of the appended claims should not be limited to the description of the embodiments contained herein.

What is claimed is:

1. A switching mechanism for actuating vacuum interrupters comprising:

a primary drawbar;

a secondary drawbar;

at least one secondary pull rod that joins said primary and secondary drawbars;

a double-threaded part threadably coupled to said primary drawbar, said double-threaded part having a threaded internal bore;

a coupling screw having one end received within said threaded internal bore; and a first and a second vacuum interrupter coupled in series, each said interrupter having a movable contact and a fixed contact;

wherein said movable contact of said first vacuum interrupter module is coupled to another end of said coupling screw, and said movable contact of said second vacuum interrupter module is coupled to said secondary drawbar, such that the rotation of said double threaded part moves said movable contacts relative to each other.

2. The switching mechanism of claim 1, wherein said double-threaded part has threads of a first pitch and said threaded internal bore has threads of a second pitch, wherein the rotation of said double-threaded part moves said movable contact of said first vacuum interrupter by the difference between said pitches.

3. The switching mechanism of claim 2, wherein said threads of said double threaded part have a dimension of 20 threads per inch, and said threads of said threaded internal bore have a dimension of 18 threads per inch.

4. The switching mechanism of claim 1, further comprising a primary pull rod removably coupled to said double threaded part.

5. An adjustable switching mechanism for actuating the movable contacts of a plurality of series coupled vacuum interrupters comprising:

a primary drawbar having an attachment bore and a pair of adjustable compression assemblies;

a secondary drawbar adapted to be coupled to one of the movable contacts;

a pair of coupling pull rods attached at one end to said secondary drawbar, and attached at another end to said primary drawbar via said adjustable compression assemblies; and a double-threaded part having threads of one pitch dimension, said double-threaded part threadably received within said attachment bore, said double-threaded part having an internal bore having threads of another pitch dimension to threadably receive a coupling screw that is adapted to be coupled to another of the movable contacts, wherein the rotation of said double-threaded part changes the position of the primary drawbar relative to said double-threaded part by the difference between said pitches.

6. The adjustable switching mechanism of claim 5, wherein said compression assemblies comprise:

a fitting body having a fitting base which is attached to said primary drawbar, and wherein said fitting body is receivable on said corresponding coupling pull rod;

a tapered ferrule disposed proximate said fitting base;

an annular ferrule disposed upon said tapered ferrule; and a compression fastener removably attached to said fitting body, wherein fastening of said compression fastener secures said fitting body to said corresponding coupling pull rod.

7. The switching mechanism of claim 5, wherein said threads of said double-threaded part have a dimension of 20 threads per inch, and said threads of said internal bore have a dimension of 18 threads per inch.

8. The switching mechanism of claim 5, further comprising a primary pull rod removably coupled to said double-threaded part.

9. An adjustable switching mechanism for series coupled vacuum interrupters, each vacuum interrupter having a movable contact that mates with a fixed contact, the switching mechanism comprising:

a primary pull rod;

a primary draw bar coupled to said primary pull rod, said primary draw bar moving a first movable contact with respect to a first fixed contact;

at least one secondary pull rod having a first end and a second end;

a secondary draw bar moving a second movable contact with respect to a second fixed contact;

a first compression assembly adjustably positioning and connecting said primary draw bar to said first end of said at least one secondary pull rod;

a second compression assembly adjustably positioning and connecting said secondary draw bar to said second end of said at least one secondary pull rod; and a double-threaded part carried by said primary pull rod and said primary draw bar, wherein positioning of said compression assemblies coarsely adjusts said movable contacts with respect to said fixed contacts, and wherein positioning of said double-threaded part finely adjusts said movable contacts with respect to said fixed contacts.

10. The switching mechanism according to claim 9, further comprising:

a coupling screw having a first thread pitch, said coupling screw connectable to said first movable contact;

said double-threaded part having a threaded shaft with a second thread pitch, wherein said double-threaded part is rotatably received by said primary drawbar, said double-threaded part having an internal bore which rotatably receives said coupling screw.

11. The switching mechanism according to claim 10, wherein a full rotation of said primary pull rod moves said double-threaded part a predetermined increment and results in rotation of said coupling screw which moves said coupling screw and said first movable contact a distance somewhat less than said predetermined amount.

12. The switching mechanism according to claim 9, wherein said compression assemblies comprise:

a fitting body having a fitting base which is attached to one of said corresponding drawbars, and wherein said fitting body is receivable on said corresponding secondary pull rod;

a tapered ferrule disposed proximate said fitting base;

an annular ferrule disposed upon said tapered ferrule; and a compression fastener removably attached to said fitting body, wherein fastening of said compression fastener secures said fitting body to said corresponding pull rod.

13. An adjustable switching mechanism for series coupled vacuum interrupter modules, each interrupter module having a movable contact that mates with a fixed contact, the switching mechanism comprising:

a primary pull rod;

a primary draw bar coupled to said primary pull rod, said primary draw bar moving a first movable contact with respect to a first fixed contact;

at least one secondary pull rod having a first end and a second end;

a secondary draw bar moving a second movable contact with respect to a second fixed contact, said secondary draw bar connected to said second end of said secondary pull rod; and a first compression assembly adjustably positioning and connecting said primary draw bar to said first end of said at least one secondary pull rod, wherein positioning of said first compression assembly coarsely adjusts said movable contacts with respect to said fixed contacts, and wherein said secondary draw bar is connected to said second end of said secondary pull rod by a second compression assembly, such that said secondary draw bar can be adjustably positioned to said second end of said at least one secondary pull rod, said compression assemblies comprising:

a fitting body having a fitting base which is attached to one of said corresponding drawbars, and wherein said fitting body is receivable on said corresponding secondary pull rod;

a tapered ferrule disposed proximate said fitting base;

an annular ferrule disposed upon said tapered ferrule; and a compression fastener removably attached to said fitting body, wherein fastening of said compression fastener secures said fitting body to said corresponding pull rod.

* * * * *